US009373436B2

(12) United States Patent
Pal

(10) Patent No.: US 9,373,436 B2
(45) Date of Patent: Jun. 21, 2016

(54) LIQUID COOLED INDUCTORS

(71) Applicant: Hamilton Sundstrand Corporation, Charlotte, NC (US)

(72) Inventor: Debabrata Pal, Hoffman Estates, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 14/324,972

(22) Filed: Jul. 7, 2014

(65) Prior Publication Data

US 2016/0005521 A1 Jan. 7, 2016

(51) Int. Cl.

| | |
|---|---|
| ***H01F 27/02*** | (2006.01) |
| ***H01F 27/10*** | (2006.01) |
| ***H01F 27/08*** | (2006.01) |
| ***H01F 27/28*** | (2006.01) |

(52) U.S. Cl.

CPC ..... *H01F 27/10* (2013.01); *H01F 27/02* (2013.01); *H01F 27/08* (2013.01); *H01F 27/2876* (2013.01); *H01F 27/2895* (2013.01)

(58) Field of Classification Search

CPC ..... H01F 27/00–27/35
USPC ..... 336/55–62
See application file for complete search history.

(56) References Cited

U.S. PATENT DOCUMENTS

| | | | | |
|---|---|---|---|---|
| 4,541,171 | A | 9/1985 | Buckley | |
| 5,682,292 | A | 10/1997 | Salanki | |
| 6,838,968 | B2 * | 1/2005 | Nick | H01F 27/12 336/57 |
| 7,002,443 | B2 * | 2/2006 | Ness | H01S 3/097 336/55 |
| 7,647,692 | B2 | 1/2010 | Lanoue et al. | |
| 7,973,628 | B1 * | 7/2011 | MacLennan | H01F 3/14 336/55 |
| 8,009,004 | B2 | 8/2011 | Ahangar et al. | |
| 8,816,808 | B2 * | 8/2014 | MacLennan | H01F 27/105 336/58 |
| 2009/0127857 | A1 | 5/2009 | Feng et al. | |
| 2009/0322460 | A1 * | 12/2009 | Lin | H01F 27/16 336/62 |
| 2015/0097644 | A1 | 4/2015 | Shepard et al. | |

FOREIGN PATENT DOCUMENTS

| | | | |
|---|---|---|---|
| DE | 2032507 | A1 | 1/1972 |
| JP | H0737724 | A | 2/1995 |
| JP | 2004273657 | A | 9/2004 |
| JP | 2009188033 | A | 8/2009 |
| JP | 2011181856 | A | 9/2011 |
| WO | WO-2012040563 | A2 | 3/2012 |

OTHER PUBLICATIONS

Extended European Search Report for Patent Application No. 15175715.0-1556 dated Dec. 21, 2015.
Extended European Search Report for Patent Application No. 14187525.2-1556 dated Feb. 17, 2015.

* cited by examiner

*Primary Examiner* — Tuyen Nguyen
(74) *Attorney, Agent, or Firm* — Locke Lord LLP; Scott D. Wofsy; Christopher J. Cillié

(57) ABSTRACT

An inductor assembly includes an inductor core, a winding, and a coolant conduit. The inductor core defines a cavity and the winding is disposed about the inductor core such that a portion of the winding is disposed within the cavity. The coolant conduit extends from a first end of the cavity towards an opposed second end of the cavity and includes an inlet port and an outlet port in fluid communication with each other through the coolant conduit.

13 Claims, 4 Drawing Sheets

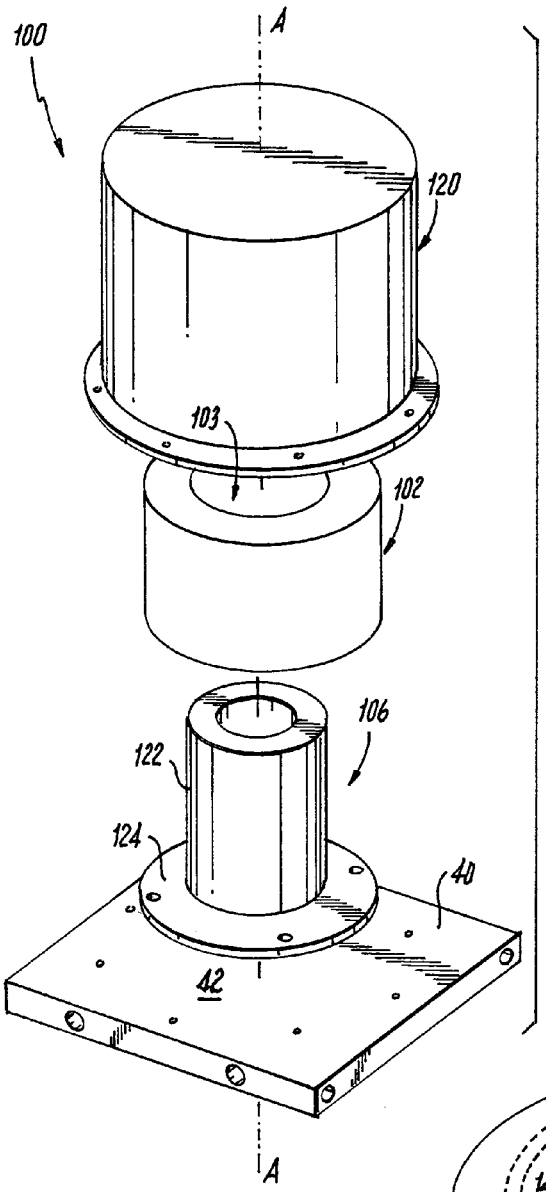
Fig. 2
Fig. 4
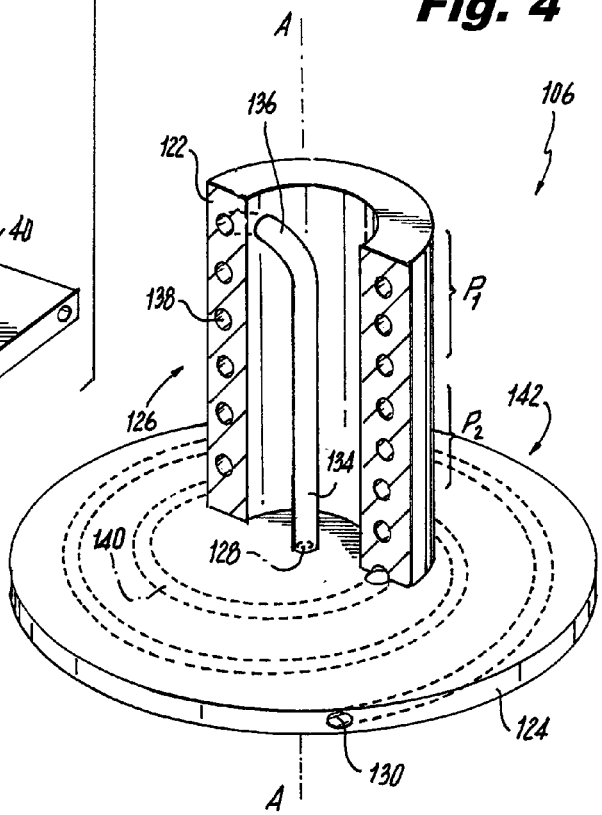

LIQUID COOLED INDUCTORS

BACKGROUND OF THE INVENTION

1. Field of the Invention

The present disclosure relates to inductors, and more particularly to inductor assemblies with liquid cooling.

2. Description of Related Art

Motor controllers commonly include power filter circuits with inductor assemblies for filtering power supplied by the motor controller. The inductor assemblies typically include conductive wires wrapped about an inductive core and fixed in place with an insulating potting compound. The inductive core generates a persistent magnetic core that opposes a magnetic field induced by current flowing through the wires wrapped about the core. Opposition of the persistent and induced magnetic field reduces variation current traversing the inductor assembly, thereby providing a filtering effect to current flowing through the assembly.

Current flowing through inductor assemblies generally produces heat. In some types of inductor assemblies, the heat generated by current traversing the conductive wires is sufficient to limit the current carrying capability, e.g. the current rating, of the inductor assembly. It can also influence core size, core material selection, and/or the reliability of the filtering functionality provided by the core. Conventional inductor assemblies therefore typically have a maximum core temperature limit and corresponding current limit.

Such conventional methods and systems have generally been considered satisfactory for their intended purpose. However, there is still a need in the art for improved inductor assemblies that allows for improved current carrying capability. The present disclosure provides a solution for this need.

SUMMARY OF THE INVENTION

An inductor assembly includes an inductor core, windings, and a coolant conduit. The inductor core defines a cavity and the winding is disposed about the inductor core such that a portion of the winding is disposed within the cavity. The coolant conduit extends from a first end of the cavity towards an opposed second end of the cavity and includes an inlet port and an outlet port in fluid communication with each other through the coolant conduit.

In certain embodiments the coolant conduit can be part of a cooling element coupled to the inductor assembly. The cooling element can include integral insert and base portions. The insert portion can have a monolithic cylindrical shape that seats within the cavity defined by the inductor core such that the winding portions are disposed between the core and the insert portion. The base portion can have a monolithic, plate-like shape and can be arranged between the inductor and cold plate such that lower winding portions are arranged between the core and the base portion. The inductor assembly can include a housing enveloping portions of the core, windings, and coolant element.

In accordance with certain embodiments the coolant conduit can include channel segments external to the insert and base portions and channel portions internal to the insert and base portions. The channel segments can include an axially aligned segment and a radial segment. The axially aligned segment can be connected to the inlet port and can extend from the base portion to an opposite end of the insert portion of the cooling element. The radial segment can connect to the axially aligned segment at a radially inward end of the radial segment, and can connect to an inner surface of the insert portion at its radially outer end. It is also contemplated that the channel portions can include a helical portion defined within the insert portion and a spiral portion defined within the insert portion, e.g. within the wall thicknesses of the portions, respectively. The helical portion of the coolant conduit can connect on one end to the radial segment of the coolant conduit, can extend about and along cooling element axis, and can connect to the spiral segment of the coolant conduit on an opposite end. The spiral portion can connect to the helical portion on one end, extend about the cooling element axis within a plane substantially orthogonal to the axis, and can connect to the outlet port in the base portion.

It is contemplated that in accordance with certain embodiments the inlet and outlet ports can be arranged on a common face of the base. The face can be on a side of the base portion opposite the core. The inlet port can be arranged radially inward of the outlet port and the outlet port can be arranged radially outward of the core cavity. Gaskets can seat in the base portion and extend about the inlet and outlet ports, respectively. The face can have a fastener-receiving pattern for seating fasteners about peripheries of the inlet and outlet ports for sealably coupling the ports to a coolant supply and coolant return.

A motor controller system includes a motor controller, a cold plate, and an inductor assembly as described above. The inductor assembly includes a toroid-shaped inductor core that defines a central cavity with windings wrapped about the core. Winding portions are disposed in the central cavity and between the core and the cold plate. A cooling element with a coolant conduit is seated within the cavity and between the inductor assembly and cold plate such that the coolant conduit is adjacent to the winding portions in the central cavity and between the core and cold plate. The cooling element inlet and outlet ports are in fluid communication with the cold plate for providing coolant to the coolant conduit and removing heat from the inductor assembly.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 2 is an exploded view of the inductor assembly of FIG. 1, showing the inductor core and a cooling element;

FIG. 4 is perspective view of the cooling element of FIG. 3, showing a coolant conduit extending between inlet and outlet ports of the cooling element.

DETAILED DESCRIPTION OF THE PREFERRED EMBODIMENTS

Figure 1:
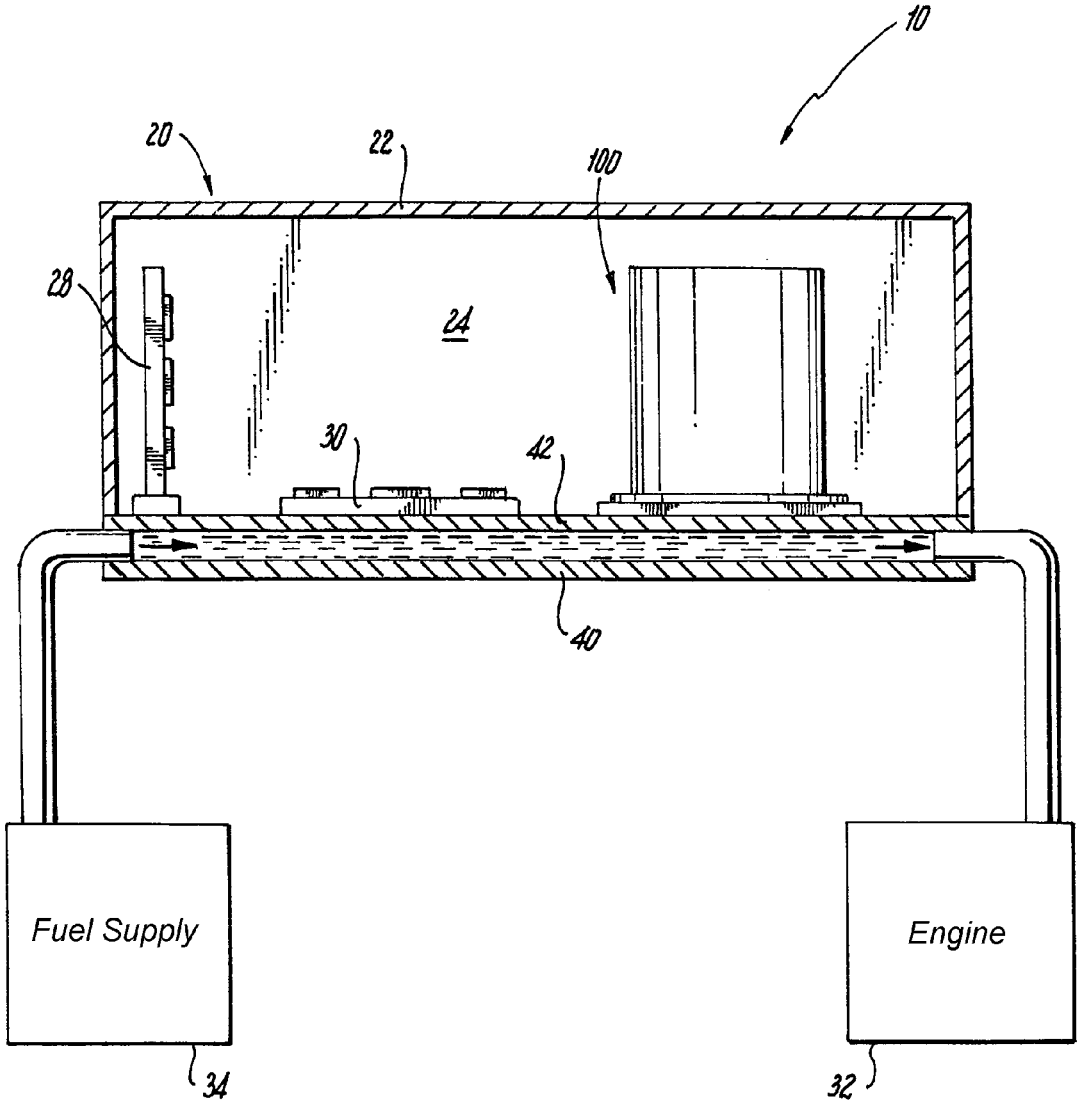
FIG. 1 is a schematic view of an exemplary embodiment of a motor controller constructed in accordance with the present disclosure, showing an inductor assembly.

Reference will now be made to the drawings wherein like reference numerals identify similar structural features or aspects of the subject disclosure. For purposes of explanation and illustration, and not limitation, a partial view of an exemplary embodiment of a motor controller system including a liquid cooled inductor assembly in accordance with the disclosure is shown in FIG. 1 and is designated generally by reference character 100. Other embodiments of inductor assemblies in accordance with the disclosure, or aspects thereof, are provided in FIGS. 2-5, as will be described. The systems and methods described herein can be used to provide coolant to inductors, for example in aerospace applications such as motor controller systems for aircraft engine common motor starter controllers.

With reference to FIG. 1, motor controller system 10 is shown. Motor controller system 10 includes a motor controller 20 and a cold plate 40. Motor controller 20 includes a housing 22 with walls 26 that define an interior 24 of housing 22. On its lower end (relative to the top of FIG. 1), interior 24 is bounded by a chilling surface 42 of cold plate 40. Cooled motor controller components including a printed wire board 28, an inverter module 30, and inductor assembly 100 are arranged within interior 24 and are configured for cooling with coolant flowing through cold plate 40. It is contemplated that inductor assembly 100 can be cooled using a coolant flow received from a power electronic cooling system. The coolant can include oil, fuel, or a propylene glycol and water mixture as suitable for a given application.

In embodiments, motor controller system 10 is supported within an aircraft, e.g. supported within a gas turbine engine 32 within an engine nacelle (not shown for clarity purposes). Cold plate 40 is in fluid communication with a fuel supply 34 and routes a portion of a fuel flow provided to gas turbine engine 32 for cooling motor controller system 10 including inductor assembly 100. Other suitable cooling arrangements can be used, such as oil cooling or the like.

With reference to FIG. 2, inductor assembly 100 is shown in an exploded view. Inductor assembly 100 includes a housing 120, a wound core 102, and a cooling element 106. Cold plate 40 is configured and adapted for providing a flow of coolant to cooling element 106. Cooling element 106 has a base portion 124 integrally connected to insert portion 122 which, in embodiments, are formed as a single component. Base portion 124 of cooling element 106 connects to cold plate 40 and is in fluid communication therewith. Wound core 102 has an annular body that defines a central cavity 103. Insert portion 122 of cooling element 106 seats within central cavity 103 and is in thermal communication with wound core 102 and windings 104 (shown in FIG. 4) wrapped around wound core 102. Housing 120 connects to cold plate 40 and envelopes between its interior surface and a portion of chilling surface 42 windings 104 (shown in FIG. 4), wound core 102, and cooling element 106.

Figure 3:
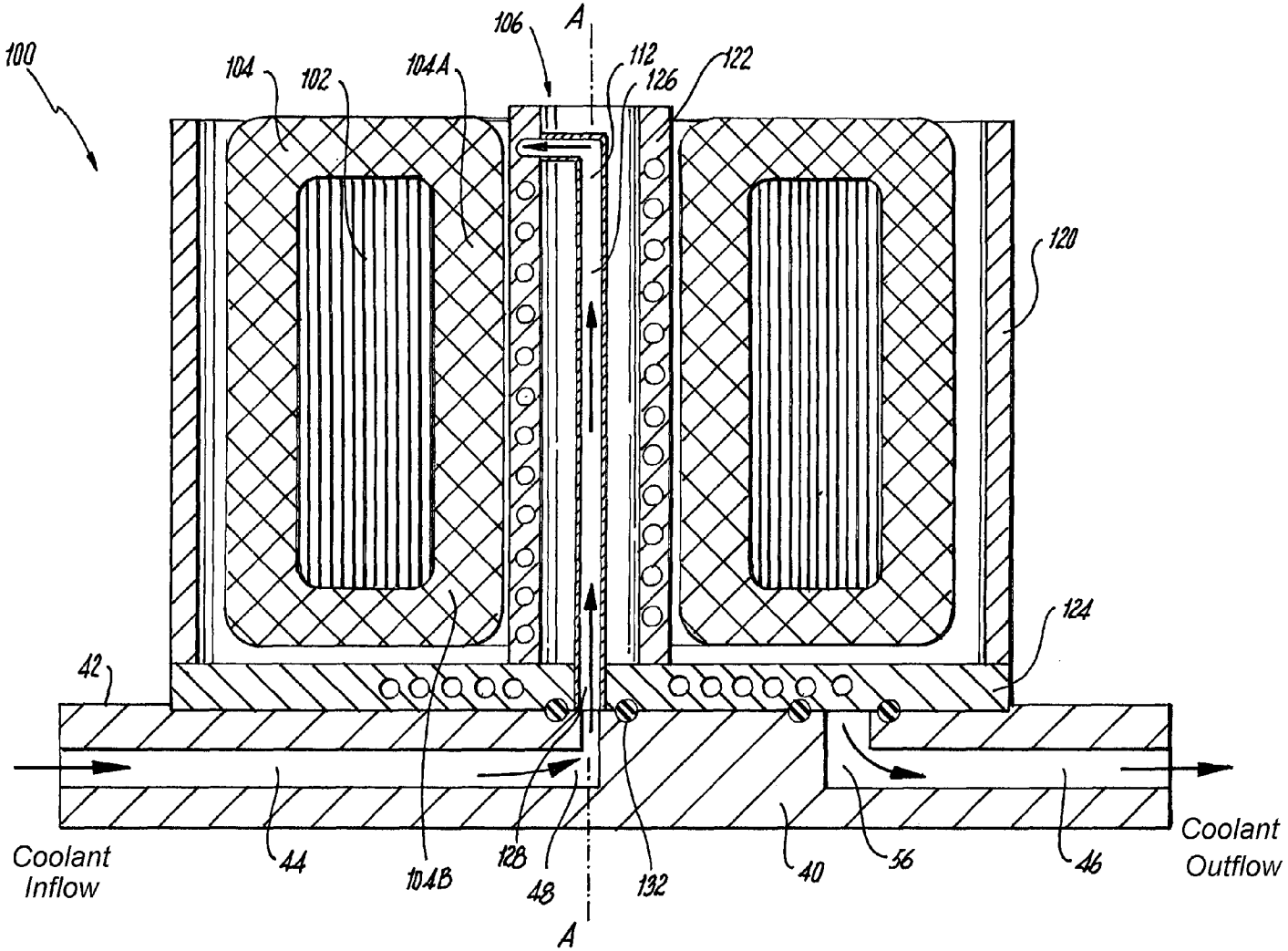
FIG. 3 is a schematic cross-sectional view of the inductor assembly of FIG. 1, showing a cooling element coupled to a cold plate and seated against the inductor assembly windings.

With reference to FIG. 3, cold plate 40 and inductor assembly 100 are shown. Cold plate 40 is connected between a coolant source, e.g. fuel supply 34 (shown in FIG. 1), and a coolant destination, e.g. fuel injectors in gas turbine engine 32. Cold plate 40 includes chilling surface 42, a coolant supply 44, and a coolant return 46. Chilling surface 42 is in thermal communication with cooled components disposed within interior 24 via mechanical contact for directly conducting heat away from the components, e.g. printed wire board 28, inverter module 30, and inductor assembly 100. Coolant supply 44 and coolant return 46 are in fluid communication with inductor assembly 100 for indirectly conducting heat away from inductor assembly 100 using coolant flowing through cold plate 40.

Inductor assembly 100 includes housing 120, wound core 102, windings 104, and cooling element 106. Housing 120 is optional, and in embodiments envelopes only a portion of wound core 102, windings 104, and cooling element 106 for isolating each from interior 24. Wound core 102 has an annular body that forms a central cavity 103 occupied by an insert portion 122 of cooling element 106, defines a central axis A, and in embodiments has a toroid-like shape. Wound core 102 is constructed from a magnetic material such as iron or ferrite, and in embodiments includes a material with a nano-crystalline structure. As will be appreciated by those skilled in the art, cores with nano-crystalline structures can have relatively low temperature limits that potentially limit the cabin air compression operating mode of an aircraft.

Windings 104 are formed from a conductive material such as copper or copper alloy wrapped about wound core 102. Windings 104 include a cavity winding portion 104A and a lower (as oriented in FIG. 3) winding portion 104B. Cavity winding portion 104A is arranged between wound core 102 and cooling element 106 and is disposed within central cavity 103 defined by wound core 102. Lower winding portion 104B is arranged between wound core 102 and chilling surface 42. As will be appreciated by those skilled in the art, the electrically conductive material generates heat due to resistive heating from current flowing through windings 104 that can influence the reliability of the filtering effect provided by inductor assembly 100. Both cavity winding portion 104A and lower winding portion 104B are in thermal communication with cooling element 106, and in the illustrated embodiment are in intimate mechanical contact with cooling element 106 for purposes of facilitating heat transfer from windings 104 to coolant traversing cooling element 106 via thermal conduction. This can improve the reliability of the filtering effect provided by inductor assembly 100. It can also increase the maximum permissible current flow through inductor assembly 100 for a given degree of filtering.

In the illustrated embodiment, cooling element 106 includes integral base portion 124 and insert portion 122. Insert portion 122 has a monolithic cylindrical shape that allows it to seat within central cavity 103 defined by wound core 102. This positions cavity winding portion 104A between wound core 102 and the insert portion 122 such that cavity winding portion 104A is adjacent coolant conduit 126. Base portion 124 has a monolithic plate-like shape that allows it to seat between wound core 102 and cold plate 40. This positions lower winding portion 104B between wound core 102 and cold plate 40 such that lower winding portion 104B is also adjacent coolant conduit 126. Monolithic construction of insert portion 122 and/or base portion 124 can improve heat transfer between respective adjacent winding portions and coolant traversing coolant conduit 126.

Cooling element 106 includes coolant conduit 126. Coolant conduit 126 connects an inlet port 128 with an outlet port 130 such that each is in fluid communication with the other. Inlet port 128 is arranged over (as oriented in FIG. 3) and in registration with inductor coolant supply 48. Outlet port 130 is also arranged over (as oriented in FIG. 3) and in registration with inductor coolant return 50. Gaskets 132 including o-ring seals are compressively engaged between chilling surface 42 and a mate face 142 (shown in FIG. 5) of base portion 124 such that leak tight interfaces are formed between inlet port 128 and inductor coolant supply 48 as well as between outlet port 130 and inductor coolant return 50, respectively.

With reference to FIG. 4, cooling element 106 is shown. Cooling element 106 includes an axially-aligned segment 134, a radial segment 136, a helical portion 138, and a spiral portion 140. Axially-aligned segment 134 and radial segment 136 are discrete segments of coolant conduit 126 formed within structures outside of insert portion 122 and base portion 124. Radial segment 136 and helical portion 138 are internal portions of coolant conduit 126 formed inside of either or both of insert portion 122 and base portion 124. It is contemplated that either or both of insert portion 122 and base portion 124 can be formed using an additive manufacturing process to define the coolant conduit portions therein.

Axially-aligned segment 134 connects to inlet port 128 and extends along axis A toward an upper (as oriented in FIG. 4) region of insert portion 122. Radial segment 136 has a radially inner end and an opposite radially outer end adjacent an inner surface of insert portion 122. Radial segment 136 connects to axially-aligned segment 134 at its radially inner end. Radial segment 136 connects to the inner surface of insert portion 122 on its radially outer end. An aperture at the connection point leads to helical portion 138 of coolant conduit 126.

Helical portion 138 extends about axis A and along at least a portion of the length of insert portion 122. Helical portion 138 traces a helicoid path and is defined wholly within the wall thicknesses of insert portion 122. In embodiments, helical portion 138 forms a circular helix with constant band curvature and constant torsion, though any other helical forms can be used without departing from the scope of the present disclosure. In certain embodiments, helical portion 138 has at least two pitches, a first pitch $P_1$ formed by helical portion 138 on an upper (as oriented in FIG. 4) end of insert portion 122 having a greater pitch than a second pitch $P_2$ formed on a lower (as oriented in FIG. 4) end of insert portion 122. This can reduce temperature variation within wound core 102, potentially improving the filtering effect provided by inductor assembly 100 by reducing variation within a persistent magnetic field generated by wound core 102.

Spiral portion 140 extends about axis A and radially outward therefrom through at least a portion of base portion 124. Spiral portion 140 traces a spiraling path from a junction with helical portion 138 (located within one of insert portion 122 and base portion 124) to outlet port 130. This places inlet port 128 in fluid communication with outlet port 130 through axially-aligned segment 134, radial segment 136, helical portion 138, and spiral portion 140.

Figure 5:
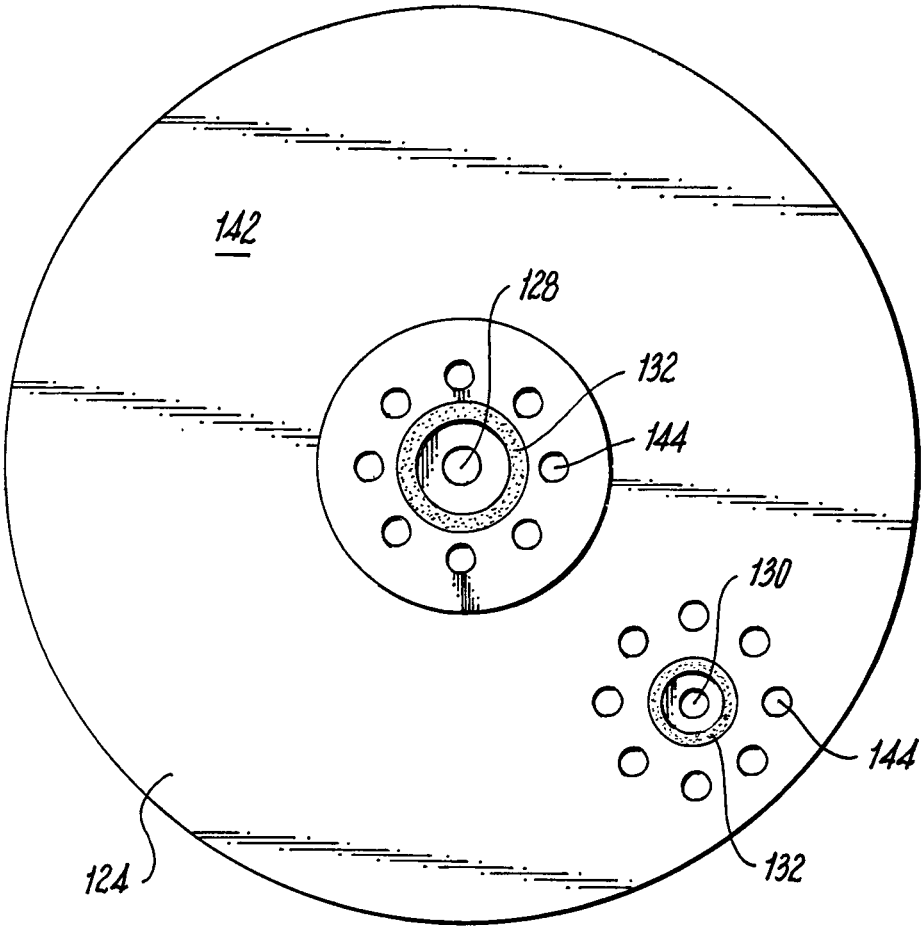
FIG. 5 is a plan view of the coolant element of FIG. 2, showing an engagement surface for seating the inductor assembly to the cold plate and sealably placing the cooling element in fluid communication with the cold plate.

With reference to FIG. 5, a mate face 142 of base portion 124 is shown. Base portion 124 is configured and adapted for engagement with chilling surface 42 of cold plate 40, and defines respective entrances to inlet port 128 and outlet port 130. As illustrated, annular grooves defined within mate face 142 are configured and adapted for seating gaskets, e.g., gaskets 132, about respective peripheries of inlet port 128 and outlet port 130. Respective fastener-receiving patterns 144 are disposed radially outward of inlet port 128 and outlet port 130 for coupling cooling element 106 to cold plate 40 and compressively sealing the interface therebetween. As illustrated, the fastener-receiving patterns 144 are located radially outward from respective gaskets 132.

During operation at high altitude and/or on hot days, there can be a need for aircraft cabin compression and cooling by the aircraft environmental control system. This can impose a relatively high current draw through a motor controller, causing greater resistive heating the windings within an inductor assembly of the motor controller. Dissipation of this heat can increase the temperature of an inductor core adjacent the windings, potentially reducing the thermal margin of nanocrystalline material forming the core. In embodiments of inductor assemblies described herein, inductor assemblies have improved thermal margin due to the more direction routing of coolant to the windings adjacent the core. This can maintain the core at a lower temperature for a given amount of heat dissipation by the winding. In certain embodiments, it is contemplated that cooling element 106 can reduce the operating temperature of wound core 102 by about 30 degrees Celsius (about 54 degrees Fahrenheit) for a given amount of heat generator from winding current flow, coolant flow rate, and coolant temperature. It is to be understood and appreciated that temperature variation within wound core 102 can also be reduced.

The methods and systems of the present disclosure, as described above and shown in the drawings, provide for motor controllers and inductor assemblies with superior properties including greater current handling capacity for a given material forming wound core 102. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An inductor assembly, comprising:

an inductor core defining a cavity;

windings wrapped about the core with a cavity winding portion disposed in the cavity;

a cooling element with a base portion integrally connected to an insert portion, the insert portion being seated within the cavity;

a cold plate connected to the base portion of the cooling element; and a gasket seated between the cold plate and the base portion of the cooling element, wherein the cooling element defines a coolant conduit disposed within the inductor core cavity and adjacent to the cavity winding portion, wherein the coolant conduit extends from a first end of the cavity toward an opposed second end of the cavity and includes an inlet port and an outlet port in fluid communication with each other through the coolant conduit, wherein the gasket extends about the inlet port or the outlet port of the coolant conduit.

2. An assembly as recited in claim 1, wherein the inlet port and the outlet port are arranged on a mate face of the base portion of the cooling element engaged to a chilling surface of the cold plate.

3. An assembly as recited in claim 1, wherein the inductor core defines a central axis, wherein the inlet port is arranged radially inward of the outlet port relative to the central axis.

4. An assembly as recited in claim 1, wherein the inductor core defines a central axis, wherein the outlet port is arranged radially outward of the cavity relative to the central axis.

5. An assembly as recited in claim 1, wherein the inductor core defines a central axis, wherein the coolant conduit includes a radial segment extending radially outward and toward the inductive core relative to the central axis.

6. An assembly as recited in claim 5, wherein the coolant conduit includes an axially aligned segment connected between the inlet port and a radially inner end of the radial segment.

7. An assembly as recited in claim 5, wherein the coolant conduit includes a helical portion connected to a radially outer end of the radial segment and extending toward the outlet port.

8. An assembly as recited in claim 7, wherein the helical portion traces a helicoid path extending about the cavity and adjacent winding portion disposed within the cavity.

9. An assembly as recited in claim 7, wherein the helical portion is defined within the insert portion of the cooling element.

10. An assembly as recited in claim 7, wherein a helical pitch of the helical portion is greater at the first end of the cavity than at the second end of the cavity.

11. An assembly as recited in claim 1, wherein the cold plate has a coolant channel in fluid communication with the inlet port.

12. An assembly as recited in claim 11, wherein the base portion of the cooling element is arranged between the cold plate and the inductor core, wherein the base portion of the cooling element defines a spiral portion of the coolant conduit extending radially outward, connected to the outlet port, and axially adjacent to a lower winding portion of the windings.

13. An assembly as recited in claim 12, wherein the base portion of the cooling element defines a fastener-receiving pattern defined about at least one of the inlet port or the outlet port.

* * * * *